US005638939A

United States Patent [19]

Takashima

[11] Patent Number: 5,638,939

[45] Date of Patent: Jun. 17, 1997

[54] RUN-IN TROUGH SYSTEMS FOR COOLING BED

[75] Inventor: Koichi Takashima, Toyonaka, Japan

[73] Assignee: Kyoei Steel Co., Ltd., Hirakata, Japan

[21] Appl. No.: 498,703

[22] Filed: Jul. 3, 1995

[30] Foreign Application Priority Data

Mar. 7, 1995 [JP] Japan ..... 7-077437

[51] Int. Cl.[6] ..... B65G 47/04

[52] U.S. Cl. ..... 198/468.8; 198/448; 198/634; 193/40; 414/745.1

[58] Field of Search ..... 198/447, 448, 198/451, 468.8, 633, 634; 193/32, 40; 414/745.1, 745.7, 746.4

[56] References Cited

U.S. PATENT DOCUMENTS

| | | | |
|---|---|---|---|
| 3,972,402 | 8/1976 | Karlberger | 198/633 |
| 4,448,298 | 5/1984 | Matsuo | 198/451 |
| 4,505,374 | 3/1985 | Beerens et al. | 198/448 |
| 4,711,340 | 12/1987 | Duri | 198/451 |
| 4,905,816 | 3/1990 | Matsuo et al. | 198/448 |
| 5,301,794 | 4/1994 | Tomasetig | 414/746.4 |

*Primary Examiner*—Joseph E. Valenza

*Attorney, Agent, or Firm*—Wenderoth, Lind & Ponack

[57] ABSTRACT

The present invention simplifies the structure of a run-in trough system for a cooling bed by constructing a device for stopping steel bars supplied to the run-in trough with a lower brake shoe of a trough type provided in a way as to move in a vertical direction together with the open trough. An upper brake shoe is provided swingably in a vertical direction on a fixed shaft provided on the main body of the run-in trough body, and a driving device is provided for the upper brake shoe.

3 Claims, 8 Drawing Sheets

RUN-IN TROUGH SYSTEMS FOR COOLING BED

BACKGROUND OF THE INVENTION

The present invention relates to a run-in trough system (High Speed Delivery System) for a cooling bed that stops steel bars formed in a prescribed shape by the rolls of the final finishing stand by hot rolling equipment in a prescribed position and then transferred onto a cooling bed for the subsequent process without having any steel jump out from the run-in trough or experience deformation.

In the production of steel bars by means of hot rolling equipment, ingots, or billets, of uniform unit weight must be used as material for effectively manufacturing high-accuracy steel bar products having a specified diameter and length with little loss. However, it is practically impossible to have all ingots or billets uniform in weight and, in any case, the final cut pieces are not uniform in length.

As a result, in a conventional run-in trough system, it is difficult to stop steel bars at any predetermined position without having any jump out from the run-in trough or deformation, because the steel bars formed in a prescribed shape by the rolls of the final finishing stand of hot rolling equipment and sent out onto the cooling bed have different inertia depending on their shape, i.e. their diameter or length. For that reason, it has been a normal practice to have some margin in the length of the run-in trough. But this had the problem of requiring larger sizes for both the equipment and the factory building, therefore, leading to a bigger investment.

Moreover, there was also the problem of a drop in working efficiency because the top ends of the steel bars were not aligned if they couldn't be stopped at a prescribed position on the run-in trough, and had to be aligned in the subsequent process.

To solve the problems of the conventional run-in trough system, the applicant of the present invention previously proposed a run-in trough system for cooling bed for transferring hot rolled steel bars to cooling beds constructed by splitting the run-in trough into a plural number of parts in the direction of steel bar length. The parts were arranged swingably in a vertical direction on a fixed shaft provided on the main body of the run-in trough. A open trough received steel bars supplied onto the run-in trough in a state in contact with a closing plate at the upper position and discharged the steel bars at the lower position, the open trough having a driving device. An inclined chute is higher than the open trough when the open trough is in the lower position and at a distance sufficient to enable passage of the open trough moving in a vertical direction. Steel bars were received when the open trough moves downward and transfers the received steel bars to the cooling bed, and the system was provided with a device for stopping the steel bars supplied onto the run-in trough (refer to European Patent No. 331340). However, this apparatus had the problem of requiring a complicated equipment structure because the device for stopping the steel bars supplied to the run-in trough was provided in disregard of the open trough of the run-in trough.

SUMMARY OF THE INVENTION

In view of the above problems, the object of the present invention is to provide a run-in trough system for a cooling that is bed simplified in construction by providing a device for stopping steel bars supplied to the run-in trough, in relation to the open trough of the run-in trough.

To achieve the object, the gist of the present invention exists in that it is a run-in trough system for a cooling bed for transferring hot-rolled steel bars to cooling bed is realized by splitting the run-in trough into a plural number of parts in the direction of length of steel bars. This is done by constructing the parts with an open trough, arranged swingably in the vertical direction on a fixed shaft provided on the main body of the run-in trough, for receiving steel bars supplied on the run-in trough in a state in contact with a closing plate at an upper position and discharging the received steel bars at a lower position. A driving device of the open trough is provided and an inclined chute which is provided higher than the open trough when the open trough is at the lower position and at a distance sufficient to enable passage of the open trough moving in the vertical direction. Steel bars are received when the open trough moves downward and transfers the received steel bars to the cooling bed. A stopping device for stopping the steel bars supplied on the run-in trough is composed of a lower brake shoe of a trough type provided between the open trough in a way so as to move in the vertical direction together with the open trough and the driving devices. An upper brake shoe is provided swingably in the vertical direction on a fixed shaft provided on the main body of the run-in trough, and a driving device of the upper brake shoe is provided.

In this case, the stopping device can stop the steel bar accurately at the prescribed position on the run-in trough by being provided at a point or at a plural number of points between the open troughs in the neighborhood on the inlet side of the run-in trough.

The steel bars supplied onto the run-in trough are introduced into the open trough which is in a closed state at the top with a closing plate and into the lower brake shoe of the trough type provided between said open trough in a way to move together in a vertical direction with the open trough and stopped between the lower brake shoe and the upper brake shoe provided swingably in a vertical direction on a fixed shaft provided on the main body of the run-in trough with a dropping of the upper brake shoe caused by the driving means of the upper brake shoe, to stop accurately at the prescribed position on the run-in trough without any jump out from run-in trough or deformation.

After that, the open trough and the lower brake shoe are made to drop in a state storing the steel bar by means of driving the upper brake shoe to transfer the steel bar onto the inclined chute.

The steel bars transferred onto the inclined chute drop on the cooling bed for cooling.

In this way, according to the present invention, it becomes possible to not only simplify the equipment structure but also stop steel bars accurately at the prescribed position on the run-in trough without any jump out from the run-in trough or deformation, and to smoothly transfer the steel bars from the run-in trough to the cooling bed for the subsequent process by providing means for stopping the steel bars supplied to the run-in trough between said open trough and constructing the lower brake shoe of the stopping means in a way to move together in a vertical direction with the open trough.

DETAILED DESCRIPTION OF THE PREFERRED EMBODIMENTS

An explanation is given below for a run-in trough system for a cooling bed of the present invention based on the illustrated embodiment.

Figure 1:
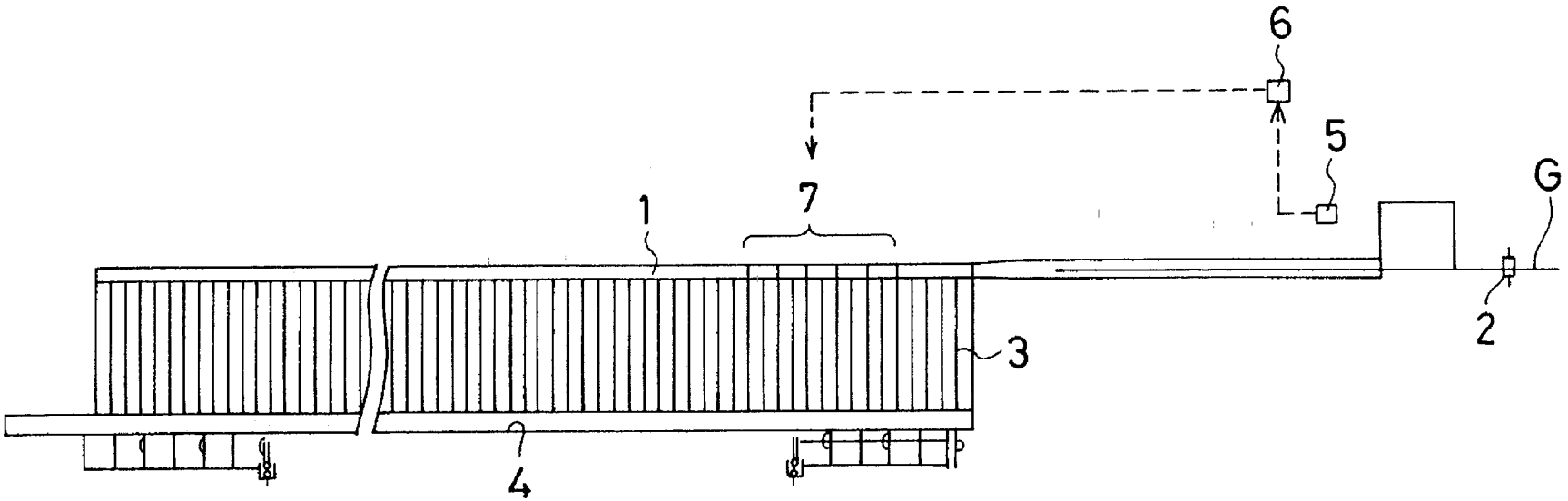
FIG. 1 is a general plan view of equipment comprising a run-in trough system for a cooling bed.

A run-in trough 1 of a run-in trough system for the cooling bed is provided on a prolonged line of a final finishing stand 2 of hot rolling equipment. It may receive a steel bar G formed in a prescribed shape by rolls of the final finishing stand of the hot rolling equipment, as shown in FIG. 1.

In the neighborhood of the final finishing stand 2 of the hot rolling equipment is provided a sensor 5 for detecting the steel bar G coming out from the rolls of the final finishing stand 2.

This sensor 5, which is composed of a photoelectric tube, for example, is connected to an automatic control circuit 6.

The automatic control circuit 6 is connected to a means 7 for stopping the steel bar G supplied to the run-in trough at a prescribed position.

This makes it possible to detect the speed and the length of the steel bars G coming out from the rolls of the final finishing stand 2 with the sensor 5 and to control the stopping means 7 in a way to stop the steel bar G supplied to the run-in trough 1 at a prescribed position by means of the automatic control circuit 6.

The installation position of the sensor 5 may be selected as desired at a position suitable for stopping the steel bar G supplied onto the run-in trough 1 at the prescribed position.

A cooling bed 3 is provided parallel with the run-in trough 1, and a run-out table 4 is provided through this cooling bed 3.

This makes it possible for the steel bars G supplied onto the run-in trough 1 and stopped at a prescribed position by the stopping means 7 to be transferred one after another onto the cooling bed 3 and, after cooling, carried out through the run-out table 4.

Figure 2:
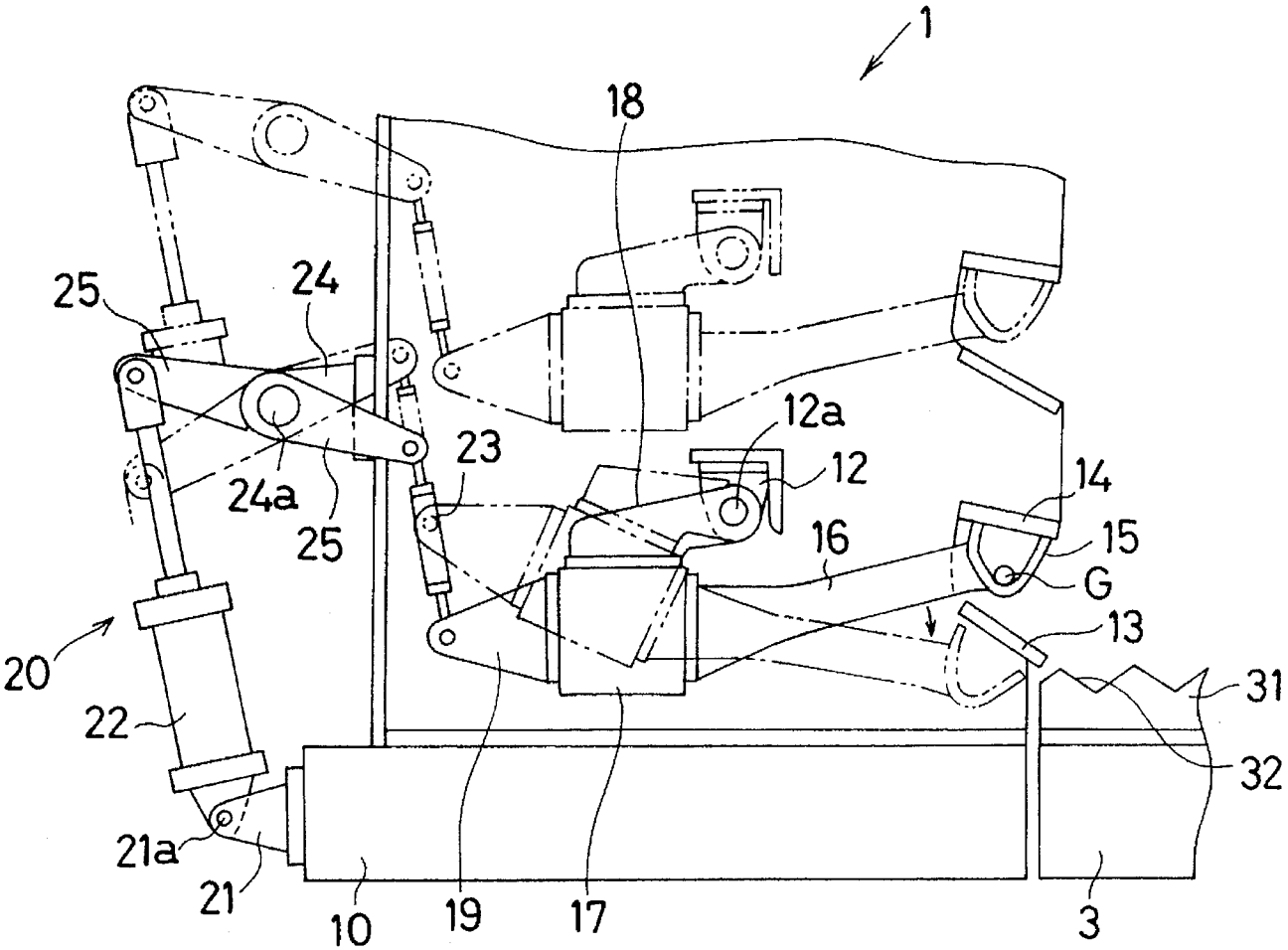
FIG. 2 is a side view of a run-in trough of the run-in trough system for the cooling bed.
Figure 3:
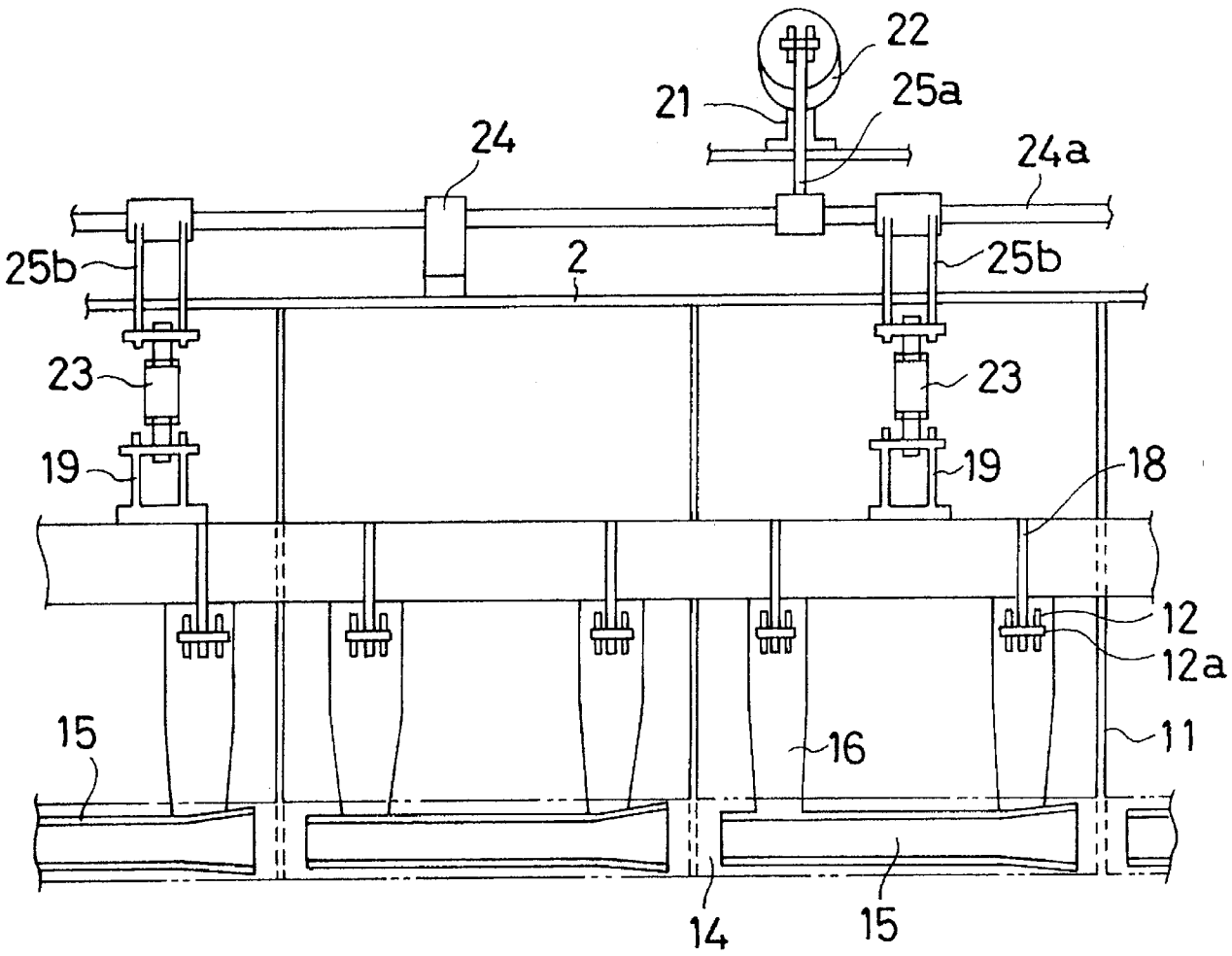
FIG. 3 is a plan view of the run-in trough of the run-in trough system for the cooling bed.
Figure 4:
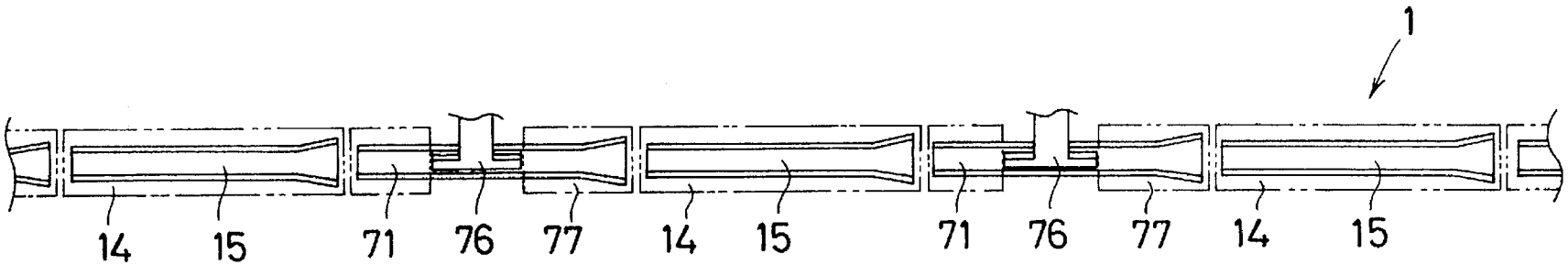
FIG. 4 is a plan view of a portion in the neighborhood on an inlet side of the run-in trough system for the cooling bed.
Figure 5:
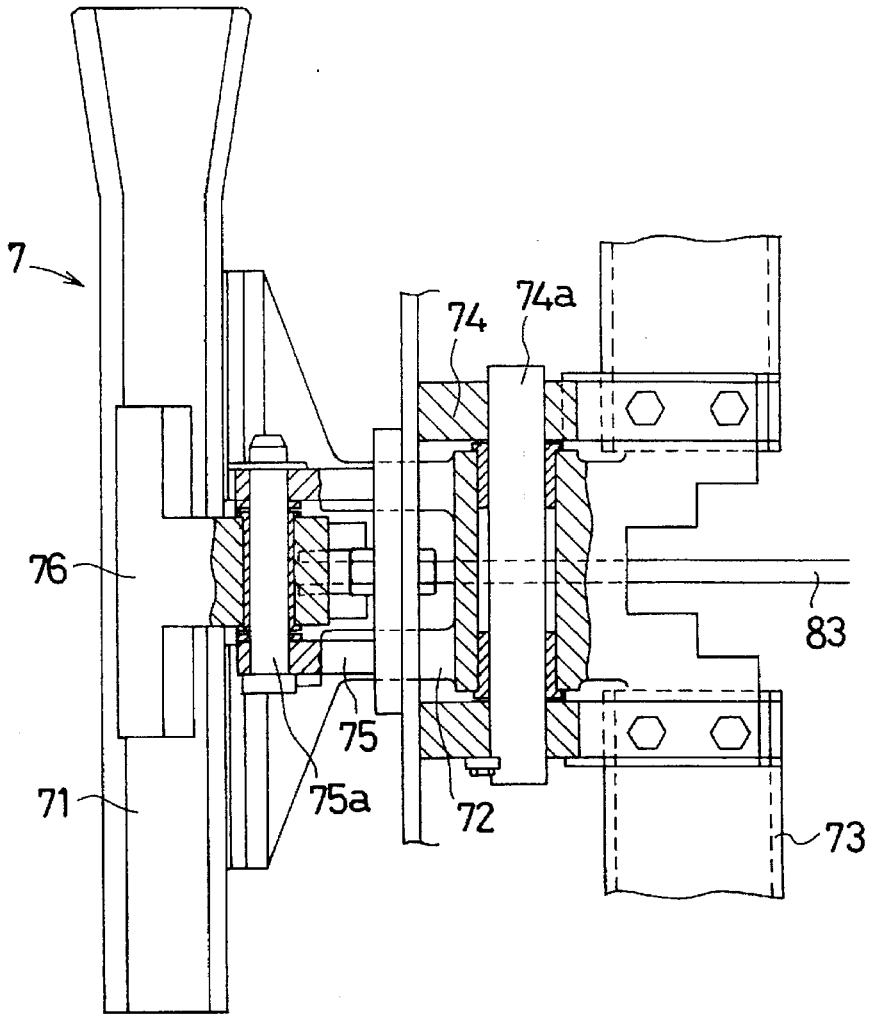
FIG. 5 is a plan view of a steel bar stopping device of the run-in trough system for the cooling bed.
Figure 6:
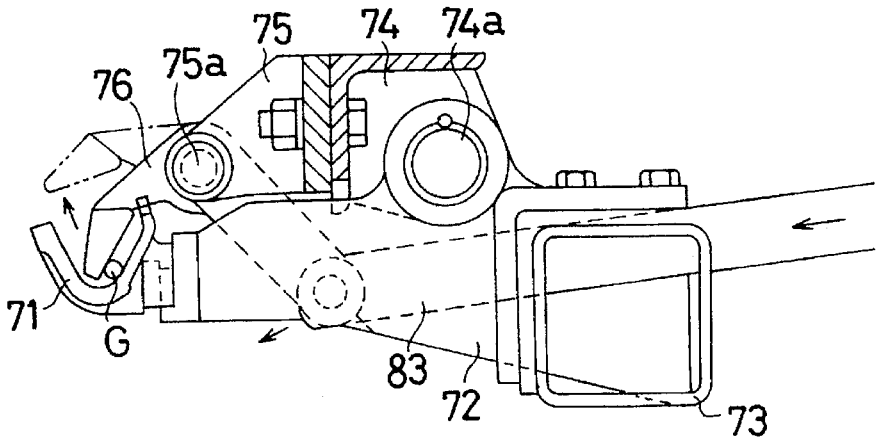
FIG. 6 is a side view of the steel bar stopping device of the run-in trough system for the cooling bed.
Figure 7:
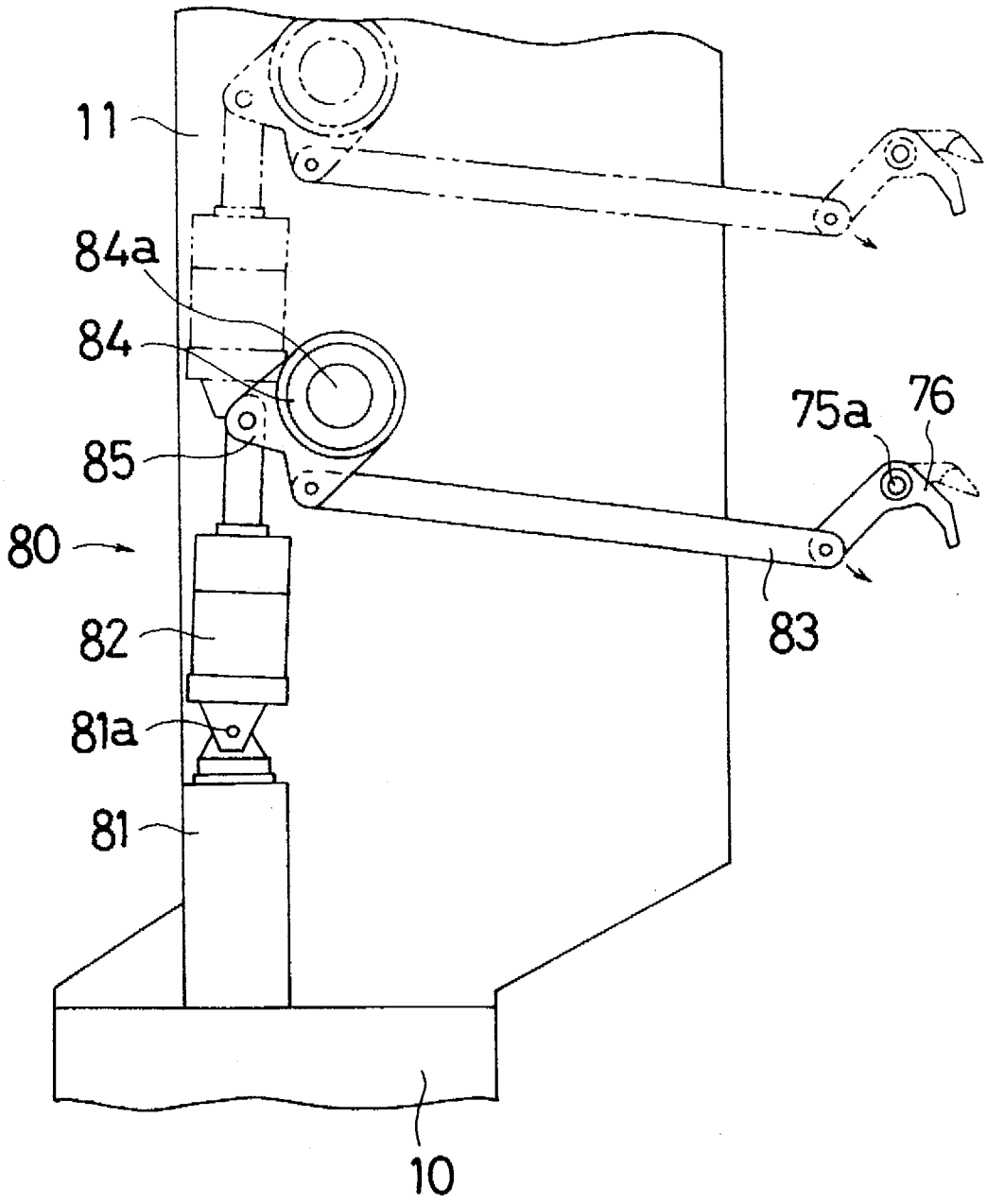
FIG. 7 is a plan view of an the upper brake shoe driving device of the steel bar stopping device of the run-in trough system for the cooling bed.

As shown in FIG. 2 and FIG. 3, the run-in trough 1 is split into a plural number of parts by frames 11 provided at equal intervals in the longitudinal direction of the run-in trough body 10. The respective split parts are provided swingably in a vertical direction on a fixed shaft 12*a* installed on a bracket 12 provided on the frames 11, and are composed of an open trough 15 which receives steel bars G supplied onto the run-in trough 1 in a state of contact with a closing plate 14 at an upper position and discharges the received steel bars G at a lower position. A driving means 20 is provided for the open trough 15. An and inclined chute 13 is provided at a position higher than the open trough 15 when the open trough 15 is at the lower position and at a distance sufficient to enable passage of the open trough 15 moving in a vertical direction. It receives steel bars G from the open trough 15 when the open trough 15 moves downward and transfers the received steel bar G onto the cooling bed 3.

The open trough 15 is provided swingably on the fixed shaft 12*a* installed on the bracket 12 provided on the frames 11 through an arm 16. A mounting beam 17 and an arm rocking lever 18 are provided integrally with the open trough 15, and are connected to the driving means 20 through an arm driving lever 19 provided integrally with the mounting beam 17.

The driving means 20 of the open trough 15 is composed of a cylinder 22 supported at one end by a fixed shaft 21*a* installed on a bracket 21 provided on the run-in trough body 10. A turnbuckle 23 is supported at one end by an arm driving lever 19 and at another end by connecting levers 25 connecting the cylinder 22 and the turnbuckle 23. The levers 25 are provided swingably on a fixed shaft 24*a* installed on a bracket 24.

The means 7 for stopping the steel bar G supplied to the run-in trough 1 at a prescribed position is composed, as shown in FIG. 4 to FIG. 7, of a lower brake shoe 71 of the trough type provided between the open trough 15 of the run-in trough in a way to move together in a vertical direction with the open trough 15, an upper brake shoe 76 provided swingably in a vertical direction on a fixed shaft 75*a* installed on a bracket 75 and a driving means 80 of the upper brake shoe 76.

Figure 8:
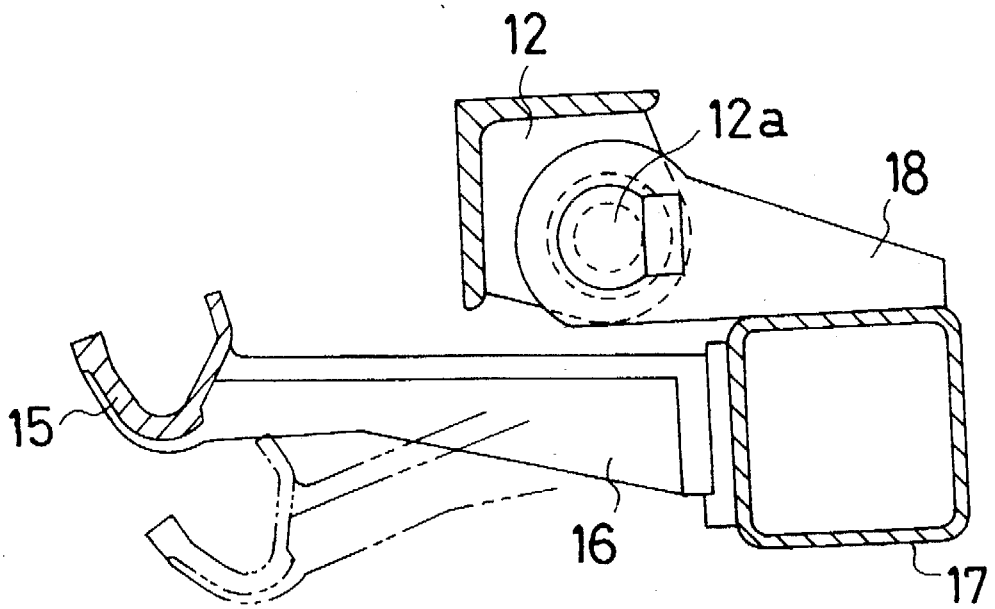
FIG. 8 is a side view showing a rocking state of an open trough of the run-in trough of the run-in trough system for the cooling bed.
Figure 9:
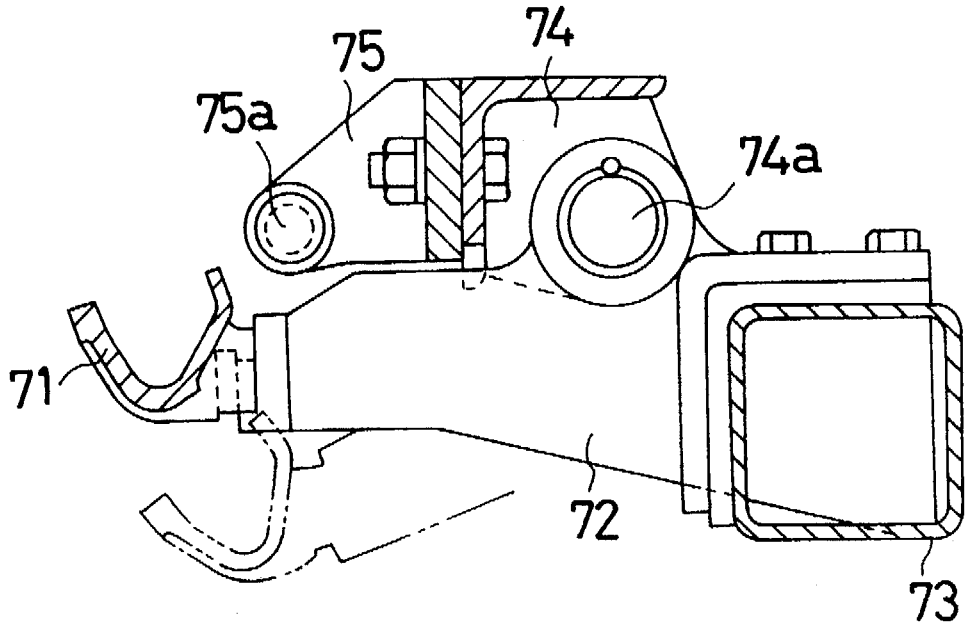
FIG. 9 is a side view showing a rocking state of a lower brake shoe of the steel bar stopping device of the run-in trough system for the cooling bed.

The lower brake shoe 71 of the trough type is provided swingably on a fixed shaft 74*a* installed on a bracket 74 provided on the frames 11 through an arm 72 and a mounting beam 73 installed integrally with the lower brake shoe 71. It is constructed in such a way as to move in a vertical direction together with the open trough 15 by means of the driving means 20 of the open trough 15 as shown in FIG. 8 and FIG. 9 by adjusting the positions of the fixed shaft 74*a* and the fixed shaft 12*a*, as well as the positions of the arm 72 and the mounting beam 17 and by connecting the mounting beam 73 and the mounting beam 17 of the open trough 15, etc.

The driving means 80 of the upper brake shoe 76 is composed of a cylinder 82 supported at one end by a fixed shaft 81*a* installed on a bracket 81 provided on the run-in trough body 10, a link 83 supported at one end by the upper brake shoe 76 and at the other by a connecting lever 85 connecting the cylinder 82 and the link 83 and provided swingably on a fixed shaft 84*a* installed on a bracket 84 provided on the frame 11.

In this case, the stopping means 7 can stop the steel bars G accurately at a prescribed position on the run-in trough 1 by being provided at a point or at a plural number of points between the open trough 15 in the neighborhood of the inlet side of the run-in trough Moreover, in the case where the length in the longitudinal direction of the lower brake shoe 71 of the trough type is larger than the length of the upper brake shoe 76, as in this embodiment, a closing plate 77 closes the opening of the lower brake shoe 71 of the trough type, when the lower brake shoe 71 of the trough type is in an upper position in the same way as the open trough 15, is provided so as to receive the steel bars G supplied to the run-in trough 1 in a state where the lower brake shoe 71 is in contact with the closing plate 77.

Figure 10:
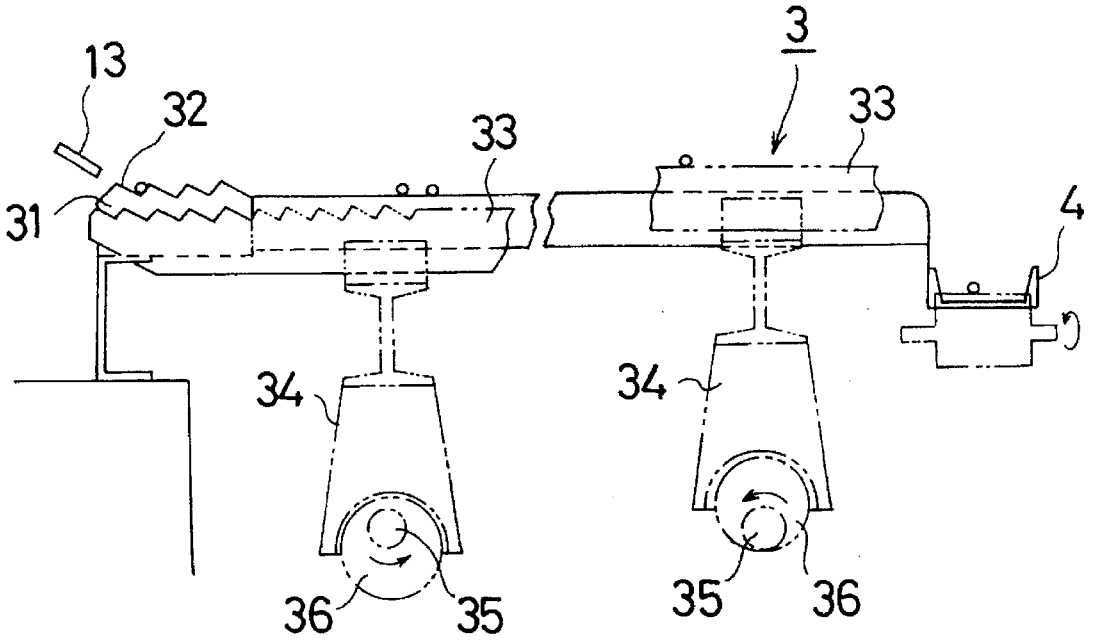
FIG. 10 is a side view of the cooling bed.

In this embodiment, a Rackover type cooling bed as shown in FIG. 10 is used as the cooling bed 3.

The cooling bed 3 has a fixed notch bar 31 with a serrated top face and a movable notch bar 33, holding the movable notch bar 33 with a saddle 34 and placing the saddle 34 on an eccentric sieve 36 installed on a rotary shaft 35.

The rotary shaft 35 makes a turn if the sensor 5 detects that a supply of steel bars G is going to the run-in trough 1, or at regular intervals, to thereby move the steel bars G on the cooling bed 3 by one pitch of the Fixed notch bar 31 and repeats this action thereafter to perform cooling while transferring the steel bars G from the run-in trough 1 side to the run-out trough 4 side.

While in this embodiment 2 pairs of units consisting a cooling bed 3, an inclined chute 13, a closing plate 14, an open trough 15, a driving means 20 for the open trough 15, a lower brake shoe 71, an upper brake shoe 76, a driving means 80 for the upper brake shoe 76, etc. are provided in parallel at the top and the bottom, the number of unit(s) to be provided on the run-in trough 1 may be one pair only or 3 pairs or as many as required.

Next, an explanation will be given on the actions of the run-in trough system for the cooling bed.

First, the open trough 15 and the lower brake shoe 71 arranged along the overall length of the run-in trough 1 comes in contact with the closing plate 14 and the closing plate 77 respectively, in an upward motion of the open trough 15 by the cylinder 22 of the driving means 20 and receives the steel bar G supplied to the run-in trough 1 in this state.

At that time, the open trough 15 can be put in close contact with the closing plate 14 by an adjustment of the turnbuckle 23. For that reason, any assembling error of parts constituting the open trough 15, i.e. the open trough 15, the arm 16, the mounting beam 17, the arm rocking lever 18, or the arm driving lever 19, etc. can be easily rectified and, therefore, it becomes possible to receive steel bars in the open trough 15 and the lower brake shoe 71 without any pieces jumping out or deforming.

The sensor 5 detects the speed and the length of the steel bars G coming out from the rolls of the final finishing stand 2 and the automatic control circuit 6 controls the stopping means 7 in a way to stop the steel bar G at a prescribed position on the run-in trough by pinching the steel bar G between the upper brake shoe 76 and the lower brake shoe 71 with a downward motion of the upper brake shoe 76 by the cylinder 82 of the driving means 80.

If the steel bar G stops, the upper brake shoe 76 moves into the upper home position with an upward motion by the cylinder 82 of the driving means 80 of the upper brake shoe 76, while the open trough 15 and the lower brake shoe 71 move downward with a downward motion of the cylinder 22 of the driving means 20 of the open trough 15 in a state of storing the steel bar G.

When the open trough 15 and the lower brake shoe 71, moving downward, pass through the position of the inclined chute 13, the steel bar G is received from the open trough 15 and the lower brake shoe 11 onto the inclined chute 13.

The steel bar G drops onto the first notch 32 of the notch bar 31 of the cooling bed 3 from the inclined chute 13, and is cooled while being transferred from the cooling bed 3 to the run-out table 4 side.

After that, in preparation for receiving the next steel bar G, the open trough 15 and the lower brake shoe 71 return to a state of being in contact with the closing plate 14 and the closing plate 77 respectively, with an upward motion of the open trough 15 by the cylinder 22 of the driving means 20, and the operation is thereafter repeated.

What is claimed is:

1. A run-in trough system for a cooling bed for transferring hot-rolled steel bars to the cooling bed is realized by splitting the run-in trough into a plural number of parts in the direction of the length of the steel bars by constructing said parts with an open trough, arranged swingably in a vertical direction on a fixed shaft provided on a main body of the run-in trough, for receiving steel bars supplied on the run-in trough a state of contact with a closing plate at an upper position and discharging the received steel bars at a lower position, driving means of the open trough, and an inclined chute which is provided higher than the open trough when the open trough is at the lower position and at a distance sufficient to enable passage of the open trough moving in the vertical direction, to thereby receive steel bars when said open trough moves downward and transfers the received steel bars to the cooling bed, and by comprising stopping means for stopping the steel bars supplied on the run-in trough, wherein said stopping means is composed of a lower brake shoe of a trough type provided between said parts of said open trough in a way to move in vertical direction together with said open trough and driving means, an upper brake shoe provided swingably in the vertical direction on a fixed shaft provided on the main body of said run-in trough and driving means of said upper brake shoe.

2. A run-in trough system for cooling bed as defined in claim 1, wherein said stopping means is provided between said open trough in the neighborhood of an inlet side of the run-in trough.

3. A run-in trough system for cooling bed as defined in claim 2, wherein said stopping means is provided at a plural number of points between said open trough in the neighborhood of the inlet side of said run-in trough.

* * * * *